United States Patent [19]

Dorp et al.

[11] 4,100,786

[45] Jul. 18, 1978

[54] FEED MECHANISM FOR PILGER ROLLING MILLS

[75] Inventors: Walter Vom Dorp; Hans Georg Ritter, both of Monchen-Gladbach; Fritz Witteck, Viersen, all of Fed. Rep. of Germany

[73] Assignee: Mannesmann Aktiengesellschaft, Dusseldorf, Fed. Rep. of Germany

[21] Appl. No.: 789,553

[22] Filed: Apr. 20, 1977

[30] Foreign Application Priority Data

Apr. 22, 1976 [DE] Fed. Rep. of Germany ..... 2617662

[51] Int. Cl.[2] ..... B21B 17/06

[52] U.S. Cl. ..... 72/252; 72/208

[58] Field of Search ..... 72/252, 250, 208, 35, 72/36

[56] References Cited

U.S. PATENT DOCUMENTS

| | | | |
|---|---|---|---|
| 1,041,661 | 10/1912 | Nowak | 188/311 X |
| 2,783,666 | 3/1957 | McLay | 72/252 X |

*Primary Examiner*—Milton S. Mehr

*Attorney, Agent, or Firm*—Ralf H. Siegemund

[57] ABSTRACT

A feeder is acted upon by opposing hydraulic drives and a spindle drive limits the advance. Hydraulic buffers are interposed either between the spindles and the feeder or between a carriage carrying the spindle drive and the machine bed. The buffer biasing force exceeds the force exerted by the feeder advance upon the feeder. The rate of buffer response is tracked separately.

14 Claims, 7 Drawing Figures

FEED MECHANISM FOR PILGER ROLLING MILLS

BACKGROUND OF THE INVENTION

The present invention relates to a feed mechanism for hot rolling pilger mills.

Feed mechanisms for pilger rolling mills are usually comprised of a feeder proper which is mounted for movement on a stationary bed and moves a mandrel with a hollow billet in relation to a millstand. The feeder is usually hydraulically advanced and also hydraulically retracted in the direction of rolling. In addition, such feed mechanism includes spindles which are being suitably driven and which meter the individual movement of the feed mechanism during pilger rolling.

Devices of the type described are disclosed, for example, in the German Pat. No. 304,524 as well as in the German Pat. No. 296,673; the former constituting a supplementing improvement over the latter. In accordance with the teaching of these patents it is also known to limit the advance of the feeder through suitable drive mechanism so that the movement cannot be exceeded beyond the prescribed limit. It was already recognized at that time that the rather rough operating conditions during pilger rolling wear greatly on such a mechanical feeder mechanism if its load capacity is exceeded. Ultimately this results through human error generally, and feeding and loading in particular. At that time it was deemed particularly important to avoid strong impacts between feeder and spindle because in these devices these parts do mechanically engage. Also, it was of interest to avoid other damages due to local overload conditions. Such local overload conditions may, for example, occur when the advance is adjusted too large a value or if the dimensions of the hollow billet being rolled were incorrectly predetermined, or if such billet was placed into the machine at too high a temperature.

These drawbacks were attempted to be avoided by providing a releasable stop as between feeder and spindle. It has to be observed, however, that these problems can be solved in that manner only if the principal point to be considered is the avoidance of an impact between spindle and feeder, particularly during preparation of the feeder by the operator. Loads on the spindle during pilger rolling could not be avoided because the known equipment required the operator to take the proper steps for avoiding oveload whenever he deemed it necessary. Also, each decoupling of the connection between the feed mechanism and the spindle amounted to an interruption of the pilger rolling process.

Without any doubt, a mechanically set limit of the advance of the feed mechanism has the advantage of utilizing normal, full capacity for operating the hot rolling pilger mill; and one does not have to worry about disturbances that may result from temporary, excessively large advances. Recently, a proposal has been made (French Pat. No. 1065008) to advance the feeder strictly by mechanical means of a gear rack. An alternative suggestion (French Pat. No. 1165728) proposes the use of a spindle for the principle advance of the feeder. However, the former kind of feeder advance requires an extremely sturdy construction in the gear rack as well as in the gear, the latter proposal requires an extremely sturdy advance spindle because in either case these devices have to take up the entire reaction forces exerted upon them by the feeder. It should be noted that forces may vary direction and may occur in the direction of rolling as well as oppositely thereto. Moreover, the forces may change direction rapidly; clearly such oscillatory forces produce inherently additional wear and unfortunately they introduce additional play which introduces a certain degree of unsteadiness into the position and operation of the feeder device and its advance mechanism. It should be noted, therefore, that purely hydraulically driven feeders do not incur this problem because the hydraulic has an inherently effective resiliency.

DESCRIPTION OF THE INVENTION

It is an object of the present invention to provide a new and improved feed mechanism for hot rolling pilger mills which avoids the disadvantages outlined above and which in particular is capable of taking up temporary reactive and displacement movements of the feeder without endangering the feeder drive in general and without causing an interruption of the pilger rolling process.

It is another object of the present invention to permit recognition of excessive deviations of the operation of a feed mechanism of a hot pilger rolling mills from normal operation and to provide the corrective steps remedying the situation;

it is a particular object of the present invention to improve the feed mechanism for hot rolling pilger mills which include a stationary bed, a feeder proper for connection to a mandrel, hydraulic means for advancing and retracting the feeder in direction of rolling and opposite thereto, and a geared drive (spindle, geared rack, etc.) for selective coupling to the feeder to obtain controlled and advance stop of the feeder pursuant to the pilger rolling process.

In accordance with the preferred embodiment of the present invention, it is suggested to improve such feed mechanisms by disposing resiliently reacting means in relation to the feeder, the geared drive and the bed for limiting reaction forces from the feeder upon the geared drive whereby the reacting means is adjusted to exhibit a resilient bias for providing a resilient reaction force which is in excess of the force exerted upon the feeder by the hydraulic means during and for advancing of the feeder. The geared drive is preferably a spindle drive having the plurality of spindles, but it may be a rack and pinion drive instead. Specifically, the advance portion of the hydraulic drive urges the feeder in one particular direction during pilgering and the geared drive limits that advance but yields as the pilger operation progresses. The reaction force should be adjusted so that particularly during pilgering the retraction force exerted upon the feeder together with the biasing force of the resilient reacting means is larger by about 50% than the force exerted by the hydraulic drive in direction for advancing the feeder. Bearing in mind that during the pilgering the advancing force is, of course, larger than the retraction force.

By operation of the invention it is avoided that the gear drive, particularly a spindle drive, will not have to take up excessive loads during rolling. Even though the advance motion is limited by operation, for example, of a spindle one still has available a resilient cushioning of the feeder, in that either the spindles and the feeder are interconnected through the buffer, or the buffer is interposed between spindles and feeder on one hand and the machine bed on the other hand. This way it has been made possible to combine the advantages of a hydraulic advance with the advantages of a mechanical limiting of the advance during pilgering. Moreover, it was possible to extend the permissible range of movement of the feeder without endangering overload and without detriments to the rolling operation. This range extension is actually made dependent upon the direction and magnitude of forces which the feeder exerts upon its environment.

For practicing the invention, it was found suitable to provide the resiliently reacting means in a manner which permits adjustment of the reaction force. Preferably one will use hydraulic buffers with pressure adjustment and pressure limiting. Hydraulic buffering has the advantage that it provides a constant reaction force over a relatively large stroke range. This particular feature exhibits a definite advantage over regular springs which have to be extremely long in order to obtain a comparable force range.

In accordance with the invention, it is further suggested that the reaction means is either provided directly between the feeder and the gear drive (spindles, rack) which drive is basically stationary on the machine bed, except for the rack or spindle advance. In the alternative, the geared drive is provided on a carriage, and the resilient reaction means is disposed between stationary support means, preferably two stationary supports defining a displacement range, and that carriage. The spindles on the carriage drive a follower serving as stop and advance limiter for the feeder. In general, the buffers are arranged to operate as shock absorbers in regard to feeder displacements in the direction of feeder advance, while the feeder decouples from the spindles during displacements in the opposite direction, in which case the hydraulic advance acts as hydraulic cushion. It is of further advantage to provide basically an arrangement that is characterized by symmetry to the rolling axis which is also the center axis of movement of the feeder. The spindles of spindle drives will be arranged symmetrical to that axis either alongside of the feeder or behind the feeder; for example they may be mounted on a carriage. The hydraulic means will be provided in the form of hydraulic cylinders and cylinder piston drives whereby a portion of the drive serves for advancing the feeder and another portion for retracting the feeder. Such piston-cylinder arrangements may be disposed also parallel to and alongside that axis of rolling or, in parts, in the axis of rolling. The hydraulic drive, particularly the plurality of cylinders involved and the spindles are preferably arranged in a common plane; the feeder is preferably provided with lateral arms extending in that plane and at least some of these operating elements engage these arms.

In accordance with another feature of the present invention, it was found advisable to supervise the movement of the resilient element, the displacement of a piston/cylinder arrangement in a hydraulic buffer being the displacement of piston and cylinder relative to each other. Electrical signals may be provided which represent such displacement, particular criteria may be established which initiate control and/or warning actions. Such a criteria is, for example, excessive frequencies of movement. It has to be observed that occasional response reaction of the resiliently reacting buffer device does not normally represent any serious and dangerous conditions in the feed mechanism. But it was found that a repeated and relative frequent response of the buffer within a certain period of time is indicative of some kind of error such as an error made by personnel or an error made on account of having provided for too large a rate of advance and so forth. Conveniently, the thus adduced signal can be used for purposes of control such as a reduction in the advance of the feeder device.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
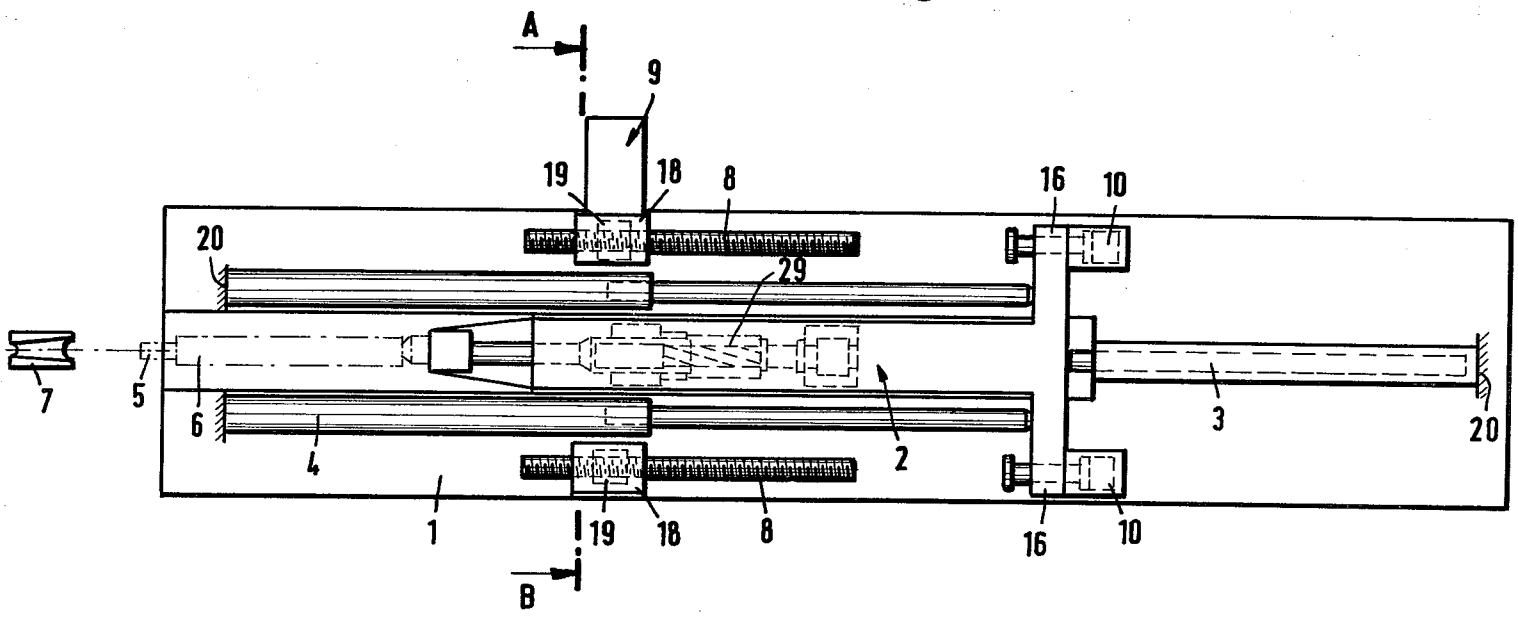
FIG. 1 is a top view of a feed mechanism in accordance with the preferred embodiment of the present invention including two laterally disposed spindles, the mechanism being shown in loading position.

Proceeding now to the detailed descriptions of the drawings, the feed mechanism for a hot rolling pilger mill includes a stationary machine bed 2 on which the feed device or feeder 2 slides. A mandrel or rod 5 is releasably secured to the front end of feeder 2. The rod 5 will carry a hollow billet such as 6 during rolling. Reference numeral 29 denotes the particular drive that operates the feeder rod during pilger rolling.

The feeder 2 is advanced by means of a hydraulic actuating mechanism. This hydraulic actuating mechanism includes a hydraulic drive 3 with cylinder and piston for advance, and two drives 4 with cylinders and pistons for retraction of feeder 2. The direction of movement is, of course, the direction of rolling. The rolling mill and particularly the stand itself is not shown in detail; the drawing merely shows one pilger roll 7.

Two spindles 8 are disposed in parallel and to both sides of the rolling axis. They are accordingly disposed in parallel to the axes of the drives 4. The spindles 8 are threadedly received and driven by spindle nuts 19 held in suitable spindle sockets 18. A stationary drive mechanism including gearing 9 drives the two spindles 8.

Two arms 16 extend laterally and in opposite directions from the feeder 2, and they carry two hydraulic buffers 10. These buffers are hydraulically operated, pressure limited piston/cylinder devices whose piston/cylinder axes are aligned with the spindles 8. The cylinders of the drives 3 and 4 bear against appropriately positioned thrust blocks 20 which in turn are secured to the machine bed 1. Drive 3 engages feeder 2 centrally, while drives 4 act also on arms 16.

Figure 4:
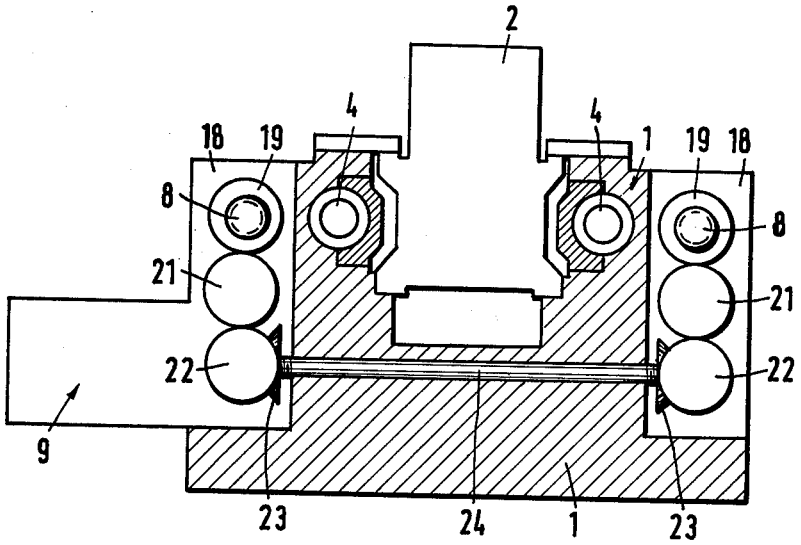
FIG. 4 is a section view along line A—B in FIG. 1.

Turning now particularly to FIG. 4 illustrating, as stated above, a section through a plane indicated by lines A and B in FIG. 1. This particular figure shows that the spindles 8, as well as the nuts 19 as mounted in the spindle bearing 18, are all disposed in the same level as are retraction drives 4. Moreover, the nuts 19 are driven from the common gearing and drive 9, via gears 21 and 22 as well as via bevel gears 23. The bevel gear connects the nut 19 to the shaft 24 which is being driven by the drive. It is apparent that a floating position of the shaft 24 permits a uniform load distribution and, therefore, a uniform load on and for the spindles 8.

The particular feed mechanism illustrated in FIGS. 1 through 4 operates as follows. The feeder 2 is shown in FIG. 1 in a position which it has assumed upon termination of loading a billet 6 upon the mandrel 5 which, of course, is releasably connected to the feed mechanism. The drive 29 of the feeder rod is presently at rest. The retraction drive 4 has been pressurized and holds the feeder 2 in the illustrated position. Now the advance drive 3 will be pressurized, i.e. charged with hydraulic fluid to move the feeder 2 against the holding action provided by the retraction drives 4.

The buffers 10 are also pressurized and are biased accordingly. As stated, the buffers 10 are hydraulically biased so that their respective reaction force when expended is still in excess of any drive force as provided by drive 3. Moreover, the combined forces of buffers 10 and drives 4 will be up to 50% larger than any force as provided by advance drive 3.

Figure 2:
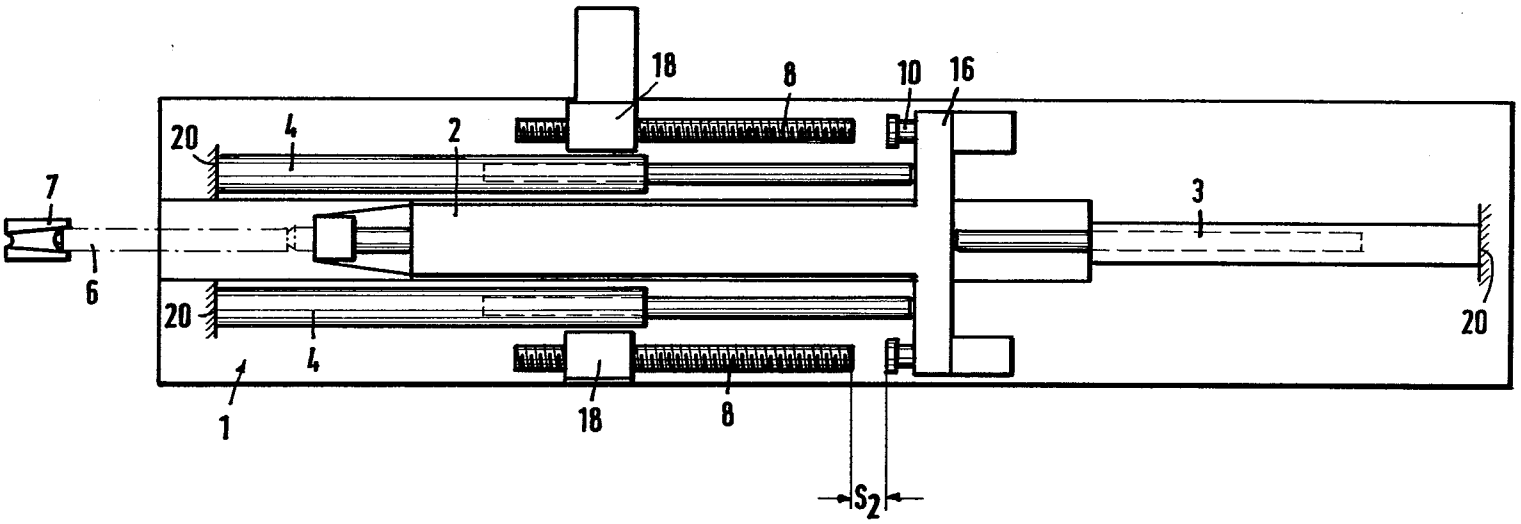
FIG. 2 illustrates the feed mechanism of FIG. 1 in the beginning of a pilger step.

The drive 3 moves the feeder until the mandrel 5 with hollow billet 6 assume the position shown in FIG. 2. It can be seen that in this particular position the buffers 10 are still somewhat spaced apart from the spindles 8, the distance is denoted by character S2. The hollow billet is now positioned for engagement by the pilger rolling stand 7. As the feeder 2 is still advanced further by operation of drive 3, the hollow billet will engage the rolls and the pilger rolling process begins.

In the initial phase of the first pilger cycle the path S2 will be traversed. This particular advance is carried out through hydraulic control, the advance rate is adjusted manually. The spindles 8 have been retracted by drive 19 by the same amount S2. The initial pilger phase could also be carried out through the spindles 8; however, it was found to be more practical to begin the operation under manual control. After the first pilger pass, the feed mechanism has, in fact, traversed the path S2 whereupon the rotating spindle 8 takes over to obtain a uniform rate of advance in accordance with the pilger rolling program processing the entire billet 6 in sequential pilger rolling steps.

Figure 3:
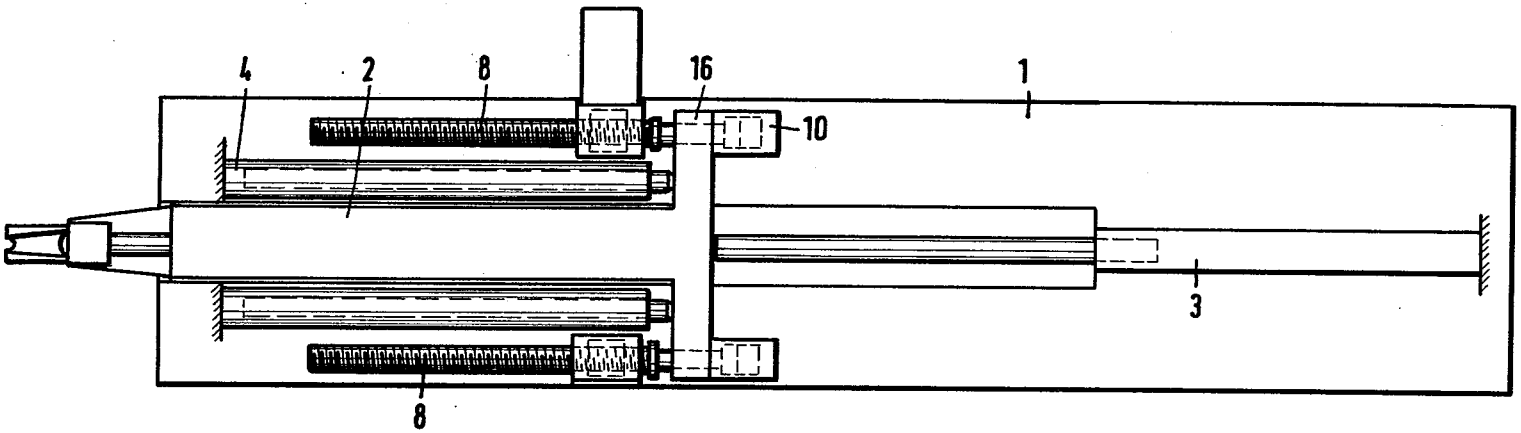
FIG. 3 shows the feed mechanism at the end of a complete pilger pass.

Upon completion of pilger rolling billet 6, the equipment has a disposition illustrated in FIG. 3. The advance drive 3 is fully protracted. The pistons of drive 4 are fully retracted. Upon releasing the advance drive 3, the drives 4 take over and return the feed mechanism to the position shown in FIG. 1. The spindle drive reverses and returns the spindles at its own rate.

Figure 5:
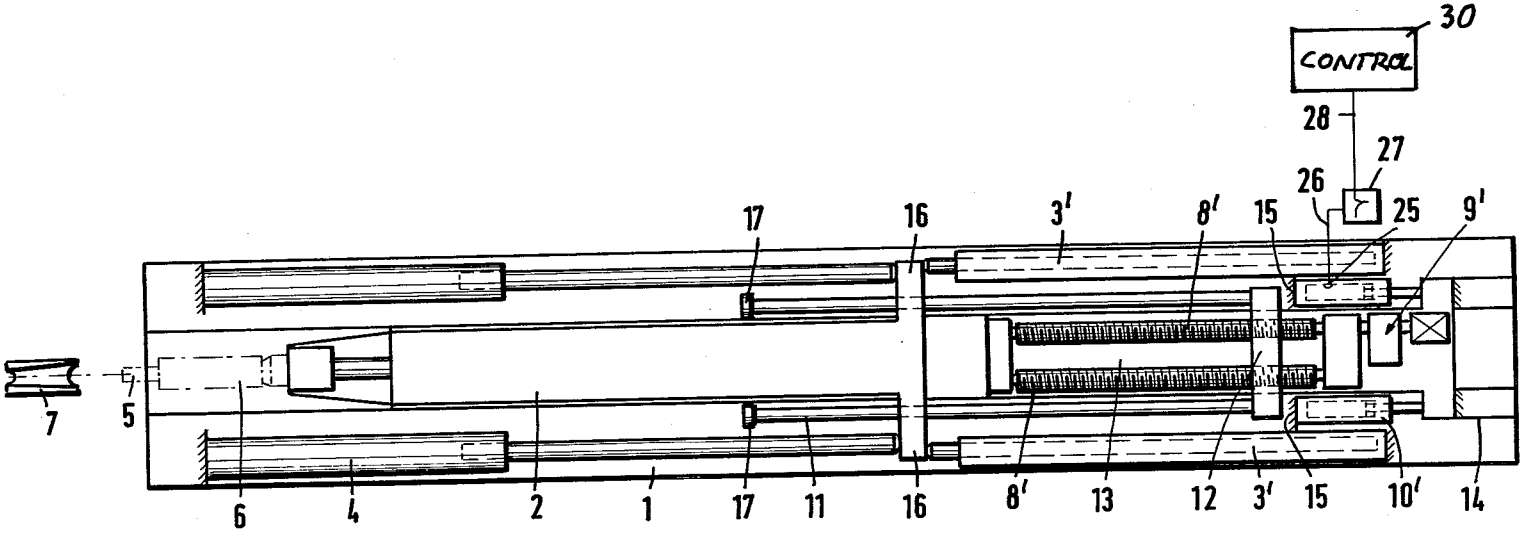
FIG. 5 is a top view of a feed mechanism which includes a modification as compared with the feed mechanism shown in FIGS. 1 through 4.
Figure 6:
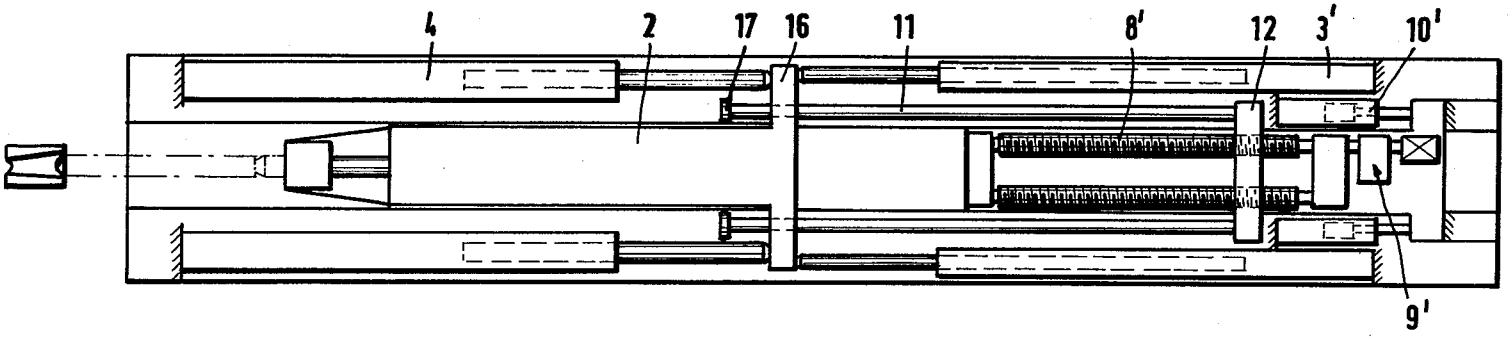
FIG. 6 shows the feed mechanism of FIG. 5 in advanced position at the beginning of a pilger step.
Figure 7:
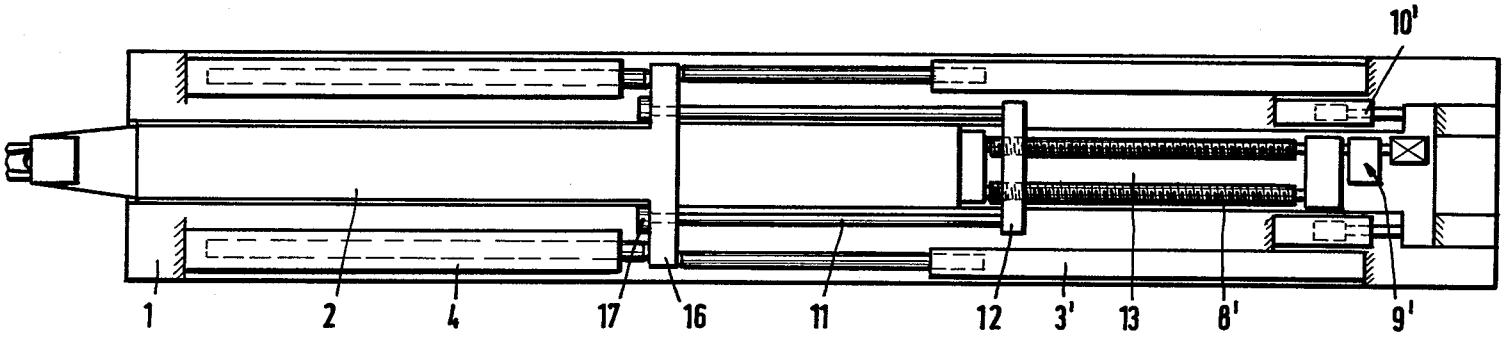
FIG. 7 shows the feed mechanism of FIGS. 5 and 6 at the end of a pilger pass.

Proceeding now to the description of FIG. 5 through 7, many parts are similar to those current FIGS. 1 through 4 and are identified by similiar reference numerals. Also, it should be said that the disposition of the equipment shown in FIGS. 5, 6 and 7 respectively correspond to the disposition within a rolling operation as shown in FIGS. 1, 2, 3. Briefly, therefore, FIG. 5 illustrates a feed mechanism during loading or charging; FIG. 6 shows the feed mechanism at the beginning of pilger rolling; and FIG. 7 shows the disposition at the end of rolling the billet 6.

However, the apparatus of FIGS. 5, 6, 7 have two hydraulic advance drives 3' which engage the arms about opposite the points of engagement of the arms 16 with the piston rods of retraction drives 4. Moreover, the spindles 8' are not positioned alongside the feeder 2 but in the rear thereof. Accordingly, the machine bed is longer and provides slide or rail facilities for a spindle carriage 13 on which the spindles 8' are mounted. Buffers 10' are provided in this instance on support blocks 15 which are secured to the machine bed 1. The carriage 13 is movable by a distant equivalent to the buffer path.

As stated, the two spindles 8' are positioned on the carriage 13 and do not move axially in the relation thereto. In addition, a drive 9' for the spindles is mounted on that carriage 13. The two spindles are interconnected by a traverse 12 which is being driven upon rotation of the spindles and is moved thereby in the direction of rolling.

Two follower rods 11 are mounted on the traverse 12. The free ends of the roller rods 11 traverse bores in the lateral arms 16 of the feeder 2 and are in free-sliding contact. In addition, the rods 11 are provided with drag or abutment heads 17, which, as will be shown more fully below, can engage the front end of the arms 16.

The carriage 13 is under the bias of buffers 10 and may rest against a rearwardly positioned thrust block 14. The cylinders of buffes 10' bear against thrust blocks 15. The blocks 14 and 15 together and in conjunction with the axial dimensions of the buffers limit the path the carriage is permitted to traverse. The buffers 10' actually bias the carriage against supports 14 so that the buffers themselves are biased accordingly. The rules as to the forces apply also here. The carriage and, therefore, the spindles assume an exactly determined and steady position. A measuring transducer 25 is disposed on one of the buffers 10' and is electrically connected wire A connection 26 to a indicating instrument 27. A further control line 28 leads from the instrument 27 to a control circuit 30 for the drive 9. The control responds to frequency of the buffer displacement, e.g., by metering the periods between sequential displacements and if their periods drop below a predetermined limit, drive 9 is reduced as to its speed.

The apparatus shown in FIGS. 5, 6 operates as follows. It is repeated that the dispositions of the feed mechanism in FIGS. 5, 6, and 7 respectively correspond to the feed mechanism in FIGS. 1, 2, and 3. Therefore, as per FIG. 5, the mandrel 5 has just been charged with the dash-dot illustrated hollow billet 6 which has been placed on the mandrel, and the latter has been connected to the feeder 2. Now the two drives 3' are charged with pressurized hydraulic fluid and move the feed mechanism 2 against the action of the retraction drives 4 until a position is reached as shown in FIG. 6. The drives 3' are partially protracted and the retraction drive 4 is partially retracted.

As soon as the drag heads 17 of the follower rods 11, abut arms 16, the first pilger pass has been completed and from now on drive 9 determines and controls the limit of the advance of feeder 2. The step wise rotating spindles 8' move the traverse 12 in steps in the direction of rolling until the entire pilger rolling process as it affects a particular billet has been completed which is the case when the equipment has a position as shown in FIG. 7.

Should any displacement of the feeder 2, or tendency to such a displacement occur during pilgering, tending to exert undue forces upon the environment, the following will transpire. If feeder 2 displaces in the direction of advance, feeder 2 is rather rigidly coupled to the spindles via arms 16, follower 11 with head 17 and traverse 12. But the spindle carriage 13 will yield on account of the biased buffers 10'. Displacement of feeder 2 in retracting direction simply causes the arms 16 to decouple from heads 17, but drives 3' themselves cushion the displacement.

At the end of pilgering, the feed mechanism has a position in which feeder 2 is rather close to the pilger rolls. The drives 3' are fully protracted and the drives 4 are fully retracted. The drag head 17 of the rods 11 bear against the arms 16 of the feed mechanism 2, and, or course, the traverse 12 has its forwardmost position. Now one can return the drive 9 so that the spindles 8' run continuously in the reverse direction to move the traverse 12 back to the position shown in FIG. 5. However, before the retraction or the traverse is initiated in that manner, the drive 3 must be releaved from pressurized fluid so that the feeder 2 can be retracted by operation of the drives 4 at relatively high speed. Otherwise the retraction of the traverse 12 is quite independent from the retraction of the feeder 2. The traverse 12, for example, can be retracted throughout the period of loading.

The invention is not limited to the embodiments described above but all changes and modifications thereof not constituting departures from the spirit and scope of the invention are intended to be included.

We claim:

1. In a feed mechanism for hot rolling pilger mills and including a stationary bed, a feeder for connection to a mandrel, hydraulic means for advancing and retracting the feeder in a direction of rolling and opposite thereto, and a geared drive for selective coupling to the feeder to limit movement of the feeder during pilger rolling, the improvement comprising:

resiliently reacting means disposed in relation to the feeder, the geared drive and the bed for limiting reaction forces from the feeder upon the geared drive and having a resilient bias to provide a resilient reaction force in excess of the force exerted upon the feeder by the hydraulic means during advancing and during pilgering the retraction and reaction forces together exceed the advance forces by 50%.

2. In a feed mechanism as in claim 1 said reacting means being at least one hydraulic, pressure limited cylinder-piston buffer.

3. In a feed mechanism as in claim 1 wherein said reacting means includes displacement means there being means for responding to the displacement of the displacement means and providing electrical signals representative thereof.

4. In a feed mechanism as in claim 3 including indicating means being particularly responsive to particular criteria for initiating controlled and/or warning operations.

5. In a feed mechanism for hot rolling pilger mills and including a stationary bed, a feeder for connection to a mandrel, hydraulic means for advancing and retracting the feeder in a direction of rolling and opposite thereto, and a geared drive for selective coupling to the feeder to limit movement of the feeder during pilger rolling, the improvement comprising:

resiliently reacting means disposed between the geared drive and the feeder and acting directly between them for limiting reaction forces from the feeder upon the geared drive and having a resilient bias to provide a resilient reaction force in excess of the force exerted upon the feeder by the hydraulic means during advancing.

6. In a feed mechanism as in claim 5 wherein said geared drive includes at least one spindle being driven for yielding in the direction of advance, said hydraulic means causing the feeder to engage said spindle via said reacting means.

7. In a feed mechanism as in claim 5 where said reacting means is mounted on the feeder, said geared drive including stationary drive means for driving at least one spindle, said spindle engaging said reacting means by operation of said hydraulic means advancing said feeder.

8. In a feed mechanism as in claim 5 wherein said geared drive includes two driven spindles arranged symmetrically to a center line of the feeder, said reacting means including two buffers for respectively acting on the two spindles.

9. In a feed mechanism as in claim 8 said spindles being arranged alongside said feeder, said feeder having two lateral arms respectively carrying the two buffers.

10. In a feed mechanism as in claim 9 said spindles being driven by a common drive.

11. In a feed mechanism as in claim 8 said hydraulic means including a plurality of drive cylinders arranged in a common plane, said spindles being located and moving in said plane.

12. In a feed mechanism for hot rolling pilger mills and including a stationary bed, a feeder for connection to a mandrel, hydraulic means for advancing and retracting the feeder in a direction of rolling and opposite thereto, and a geared drive for selective coupling to the feeder to limit movement of the feeder during pilger rolling, the improvement comprising:

said geared drive being mounted on a carriage; and resiliently reacting means disposed between the carriage and the bed for limiting reaction forces from the feeder upon the geared drive and having a resilient bias to provide a resilient reaction force in excess of the force exerted upon the feeder by the hydraulic means during advancing.

13. In a feed mechanism as in claim 12 there being two stationary support means for limiting the displacement of the carriage, the reacting means being interposed to be effective in between the two support means.

14. In a feed mechanism as in claim 12 said geared drive including two spindles and means for driving the spindles, the geared drive being arranged on a carriage, the reacting means being disposed for acting between the bed and the carriage, the geared drive being provided with at least one follower rod driven by the spindles and engaging the feeder by operation of the hydraulic means as causing the feeder to advance.

* * * * *